US007793639B2

(12) United States Patent
Hunt et al.

(10) Patent No.: US 7,793,639 B2
(45) Date of Patent: Sep. 14, 2010

(54) APPARATUS FOR REDUCING THE TRANSMISSION FOR NOISE FROM THE FUEL RAIL IN A DIRECT INJECTION ENGINE

(75) Inventors: Frank Hunt, West Bloomfield, MI (US); Atsushi Watanabe, Novi, MI (US)

(73) Assignee: Hitachi, Ltd., Tokyo (JP)

( * ) Notice: Subject to any disclaimer, the term of this patent is extended or adjusted under 35 U.S.C. 154(b) by 119 days.

(21) Appl. No.: 12/238,030

(22) Filed: Sep. 25, 2008

(65) Prior Publication Data

US 2010/0071664 A1 Mar. 25, 2010

(51) Int. Cl.
*F02M 61/14* (2006.01)
*F02M 61/18* (2006.01)

(52) U.S. Cl. ..... 123/470

(58) Field of Classification Search ..... 123/470, 123/456, 447, 468, 469; 239/533.11; 277/591, 277/626, 644

See application file for complete search history.

(56) References Cited

U.S. PATENT DOCUMENTS

| | | | | |
|---|---|---|---|---|
| 7,293,550 | B2 * | 11/2007 | Beardmore | 123/470 |
| 7,383,818 | B1 * | 6/2008 | Beardmore | 123/470 |
| 7,406,946 | B1 * | 8/2008 | Watanabe et al. | 123/470 |
| 2004/0040543 | A1 * | 3/2004 | Mickelson | 123/470 |
| 2005/0066942 | A1 * | 3/2005 | Ohkubo et al. | 123/470 |
| 2007/0113828 | A1 * | 5/2007 | Fonville et al. | 123/470 |
| 2007/0221176 | A1 * | 9/2007 | Hardy | 123/470 |
| 2008/0302336 | A1 * | 12/2008 | Fuerst et al. | 123/470 |

* cited by examiner

*Primary Examiner*—Mahmoud Gimie
(74) *Attorney, Agent, or Firm*—Gifford, Krass, Sprinkle, Anderson & Citkowski, P.C.

(57) ABSTRACT

An apparatus which reduces engine noise caused by vibration of the fuel rail in a direct injection internal combustion engine. The apparatus includes a holder which supports a fuel inlet end of the fuel injector in the fuel cup on the fuel rail so that the fuel injector is in alignment with the direct injection fuel port in the engine head. A vibration isolator is sandwiched in between the holder and either the engine head or the fuel cup to reduce the transmission of vibration from the fuel rail to the engine head.

12 Claims, 2 Drawing Sheets

APPARATUS FOR REDUCING THE TRANSMISSION FOR NOISE FROM THE FUEL RAIL IN A DIRECT INJECTION ENGINE

BACKGROUND OF THE INVENTION

I. Field of the Invention

The present invention relates generally to direct injection internal combustion engines and, more particularly, to an apparatus for reducing the transmission of vibration from the fuel rail to the engine head in direct injection engines.

II. Description of Material Art

Direct injection internal combustion engines, i.e. engines in which the fuel injector injects the fuel directly into the combustion chamber rather than upstream from the inlet valve, exhibit several advantages over the more conventional port-fuel injected internal combustion engines. Most notably, direct injection engines enjoy increased fuel economy over the other types of internal combustion engines. Direct injection internal combustion engines, however, do present special challenges for engine manufacturers and, in particular, automotive engine manufacturers.

One disadvantage of the previously known direct engine internal combustion engines is that such engines exhibit excessive noise which is particularly evident at low engine speeds. Such noise, furthermore, is directly attributable to the fuel system.

The fuel system for a direct injection engine typically comprises a fuel rail which is secured to the engine head. At least one, and more particularly several, fuel injectors are attached to and suspended from the fuel rail. A portion of each fuel injector extends through an opening in the engine head so that an end of the fuel injector is open to an internal combustion chamber for the engine. In operation, pressurized fuel from the fuel rail passes through the fuel injector and into the internal combustion engine as desired.

In order to properly supply fuel to the combustion chambers during the operation of the engine, the pressure in the fuel rail must necessarily be very high and significantly higher than previously known fuel injected engines that were not direct injection engines. In order to supply this pressurized fuel to the engine, a piston pump in a fuel pump is typically reciprocally driven by a cam having at least two or more typically three or four lobes. These lobes all contact the piston pump, usually through a roller. Upon rotation of the cam, the lobes cause the piston to move reciprocally against the force of a compression spring within the pump housing which is fluidly connected to and supplies pressurized fuel to the fuel rail.

The fuel pump also includes an inlet valve which is movable between an open and closed position by an electric coil or solenoid. In its open position, fuel flows to or from the fuel pump chamber within the pump housing through the valve port. Conversely, when the valve is moved to its closed position, the piston during the pump cycle pumps pressurized fuel through a check valve and into the fuel rail for the engine.

The operation of the fuel pumps for a direct injection engine, however, causes significant engine noise, especially at low engine speeds. The high pressure pulsation of fuel through the fuel injection induces vibration of the fuel injector which, in turn, is transmitted to the engine head and causes noise.

SUMMARY OF THE PRESENT INVENTION

The present invention provides an apparatus which reduces noise in a direct injection engine by reducing the transmission of vibration from the fuel rail and to the engine head.

In brief, the present invention provides an apparatus for reducing the transmission of vibration from the fuel rail to the engine head caused by the high fuel pressure in the fuel rail. In a direct injection engine, a fuel rail is attached to the engine head and at least one, and more typically several, fuel injectors are attached to and depend downwardly from the fuel rail. Each fuel injector, furthermore, includes a portion which extends through an opening formed in the engine head so that the distal end of the fuel injector is open to one combustion chamber for the engine. Thus, during operation of the engine, the pressurized fuel in the fuel rail flows through the fuel injector and into the combustion chamber as desired.

In order to reduce the transmission of vibration from the fuel rail to the engine head caused by the high pressure pulses of fuel which flow through the fuel injector, a holder is disposed around and supports the injector so that one end of the injector is positioned in a fuel cup fluidly connected to the fuel rail and the other end of the injector is positioned to inject fuel into the combustion chamber. The holder itself may be constructed of a vibration dampening or vibration isolator material to reduce the transmission of vibration from the fuel rail to the engine head. Alternatively, the holder may be constructed of a rigid material, such as aluminum, and a vibration dampener or isolator is sandwiched between either the holder and the fuel cup, or between the holder and the engine head.

In an alternate embodiment of the invention the holder is constructed of a vibration dampening material and is secured to the fuel cup by a threaded connection.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
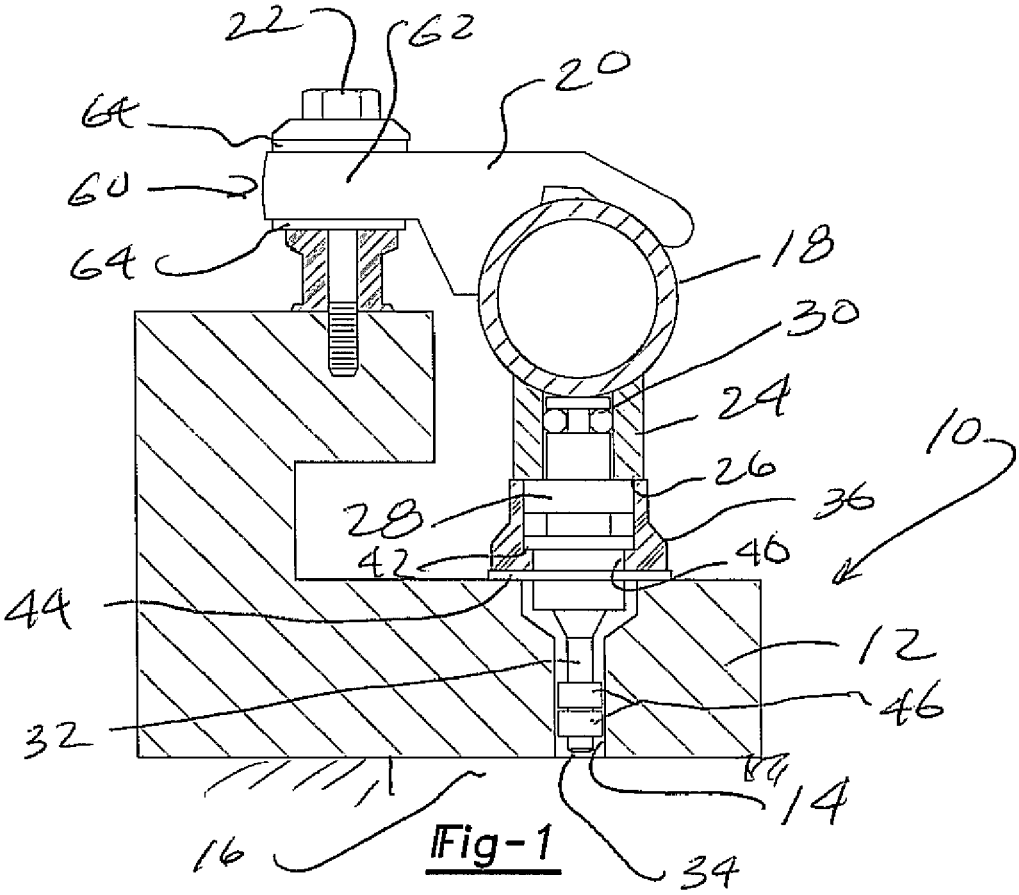
FIG. 1 is a fragmentary sectional view illustrating a first embodiment of the present invention.

With reference first to FIG. 1, a direct injection internal combustion engine 10 is shown having an engine head 12 illustrated diagrammatically. At least one opening 14 is formed through the engine head 12 and this opening 14 is open to a combustion chamber 16 for the engine 10. At least one such opening 14 is formed for each combustion chamber 16 in the engine 10.

A fuel rail 18 which contains pressurized fuel from a fuel pump (not shown) is attached to the engine head 12 by a bracket 20 and fastener 22, such as a bolt. The fuel rail 18, furthermore, is positioned adjacent the openings 14 in the engine head 12.

The fuel rail 18 includes a fuel cup 24 for each of the fuel injection openings 14 in the engine head 12. The fuel cup 24 is preferably tubular and cylindrical in shape having an open end 26 which both faces and is aligned with the opening 14 in the engine head 12. The fuel cup 24 also fluidly communicates with the fuel in the fuel rail 18.

A direct injection fuel injector 28 includes a fuel supply end 30 which is positioned within the fuel cup 24. The fuel supply end 30 of the fuel injector 28 is fluidly sealed to the fuel cup 24 by conventional fluid seals.

With the fuel supply end 30 of the fuel injector 28 positioned in the cup 24, a stem 32 of the fuel injector 28 is positioned through the engine head opening 14 so that a fuel nozzle end 34 of the fuel injector 28 is open to the combustion chamber 16. Thus, fuel flow from the fuel rail 18 flows through the fuel injector 28 out through the nozzle end 34 and into the combustion chamber 16 as desired.

In order to secure the fuel injector 28 against movement relative to the engine head 12, a holder 36 is disposed around a portion of the fuel injector 28 beneath the fuel cup 24 and above the engine head 12. This holder 36 may be made of a rigid material, such as aluminum. The holder includes an annular ledge 40 which supports a complementary annular surface 42 on the fuel injector 28 to support the fuel injector 28 against downward movement towards the engine head 12. Furthermore, since the holder 36 is capable of slight lateral movement relative to the engine head 12, the holder 36 may compensate for small misalignments between the fuel cup 24 and the fuel injector opening 14 in the engine head 12.

In order to reduce the transmission of vibrations from the fuel rail 18 to the engine head 12 which would otherwise be caused by high pressure fuel pulsations in the fuel rail 18, a resilient vibration dampener or isolator 44 is sandwiched in between the holder 36 and the engine head 12. This isolator 44 may be constructed of any suitable material, such as rubber, an elastomeric material, a synthetic polymer, or the like and, since the isolator 44 is effectively sandwiched between the engine head 12 and the fuel rail 18, fuel rail vibrations which would otherwise be transmitted to the engine head 12 are effectively dampened.

In order to further reduce the transmission of vibration between the fuel rail 18 and the engine head 12, one or more resilient seals 46 are disposed around the fuel injector stem 32 so that the seals 46 are sandwiched in between the fuel injector stem 32 and the engine head 12. These seals 46 not only fluidly seal the fuel injector stem 32 to the engine head 12, but also reduce the transmission of vibration between the fuel injector 28 and the engine head 12.

Figure 2:
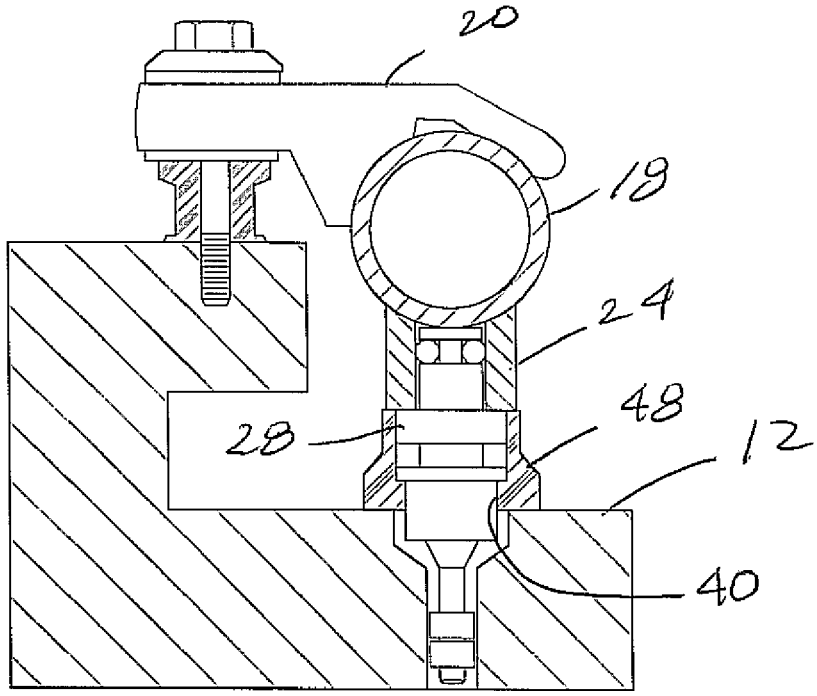
FIG. 2 is a view similar to FIG. 1 but illustrating a modification thereof.

With reference now to FIG. 2, a modification of the present invention is shown which is substantially the same as shown in FIG. 1, except the resilient isolator 44 is removed. Instead, a holder dampener 48 constructed of a vibration dampening material such as a resilient material, a composite or other synthetic material, replaces the holder 36 illustrated in FIG. 1. The holder 48 is sandwiched in between the fuel cup 24 and the engine head 12 and thus resists the downward movement of the fuel rail 18 caused by high pressure fuel pulsations in the fuel rail 18. Furthermore, since the holder 48 is constructed of a vibration isolating material, the holder 48 reduces the transmission of vibration from the fuel rail 18 to the engine head 12. Additionally, the holder 48 supports the fuel injector 28 in the same fashion that has been previously described.

Figure 3:
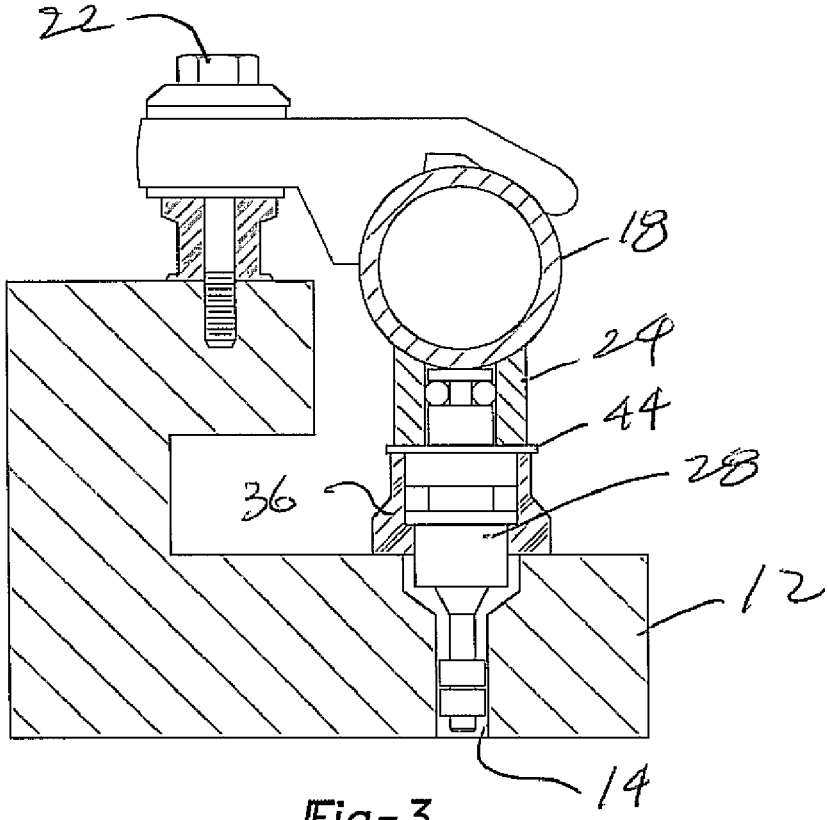
FIG. 3 is a view similar to FIG. 1, but illustrating a still further modification thereof.

With reference now to FIG. 3, a still further modification of the present invention is shown which is substantially the same as the FIG. 1 embodiment except that the isolator 44 is sandwiched in between the holder 36 and the fuel cup 24. In all other respects, however, the isolator 44 in the FIG. 3 embodiment functions in the same fashion as that illustrated in FIG. 1, i.e. the isolator 44 resists and reduces the transmission of vibration from the fuel rail 18 to the engine head 12.

Figure 4:
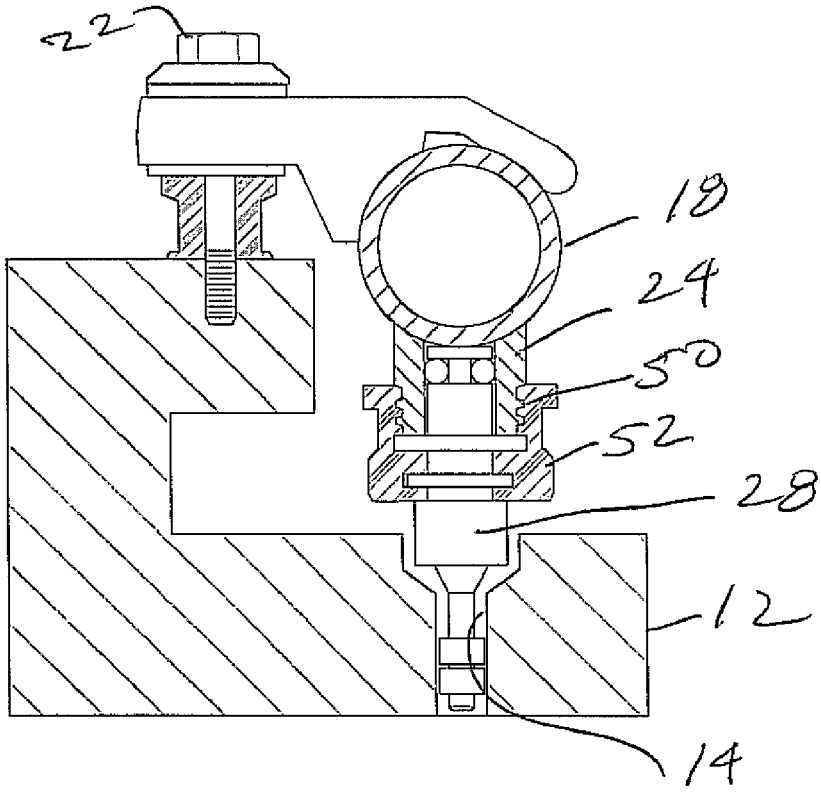
FIG. 4 is a view similar to FIG. 1, but illustrating a still further modification thereof.

With reference now to FIG. 4, a still further embodiment of the present invention is illustrated for reducing the transmission of noise from the fuel rail 18 to the engine head 12. The cup 24 includes an externally threaded portion 50. A nut 52 supports the fuel injector 28 and threadably engages the threaded portion 50 of the cup 24 to secure the fuel injector 28 to the fuel cup 24 in alignment with the engine head opening 14.

The nut 50 is constructed of a vibration isolating material, such as composite, synthetic polymer, elastomeric material or the like. As such, the nut 50 performs the same function as the holder 36 in the FIG. 1 embodiment, but also simultaneously reduces the transmission of vibration from the fuel rail 18 to the engine head 12.

Referring again to FIG. 1, in order to further reduce the transmission of vibration from the fuel rail 18 to the engine head 12, a vibration dampener assembly 60 is preferably used to secure the mounting bracket 20 for the fuel rail 18 to the engine head 12. One end of the bracket 20 is secured to the fuel rail 18 by any conventional means, such as welding. A second end 62 of the bracket 20 is secured to the engine head 12 by the dampener assembly 60.

The damper assembly 60 includes a pair of resilient cushions 64 which are disposed on opposite sides of an end 62 of the bracket. The fastener 22 then extends not only through the end 62 of the fuel rail bracket, but also through the cushions 64. Thus, the resilient cushions 64 also serve to isolate the fuel 18 and engine head 12 in order to reduce the transmission of vibration.

From the foregoing, it can be seen that the present invention provides a simple yet effective device for not only supporting the fuel injectors to the fuel rail fuel cup which reduces the transmission of vibration from the fuel rail to the engine head. Having described our invention, however, many modifications thereto will be apparent to those skilled in the art to which it pertains without deviation from the spirit of the invention as defined by the scope of the appended claims.

We claim:

1. In a direct injection engine having a head with an opening to a combustion chamber, a direct injection fuel injector having a portion extending into said head opening and a fuel rail which supplies pressurized fuel through a fuel cup to the direct injection fuel injector, apparatus to reduce the transmission of vibration from the fuel rail to the engine head comprising:

a holder disposed around a fuel inlet end of the fuel injector in the fuel cup so that the fuel injector extends through the holder and is in alignment with the engine head opening, a vibration isolator sandwiched between the holder and at least one of the engine head and the fuel cup so that said vibration isolator dampens vibrations between the fuel cup and the engine.

2. The invention as defined in claim 1 wherein said isolator is constructed of an elastomeric material.

3. The invention as defined in claim 1 wherein said isolator is constructed of a synthetic polymer material.

4. The invention as defined in claim 1 wherein said isolator is sandwiched between the holder and the engine head.

5. The invention as defined in claim 1 wherein said isolator is sandwiched between the holder and the fuel cup.

6. The invention as defined in claim 1 and comprising a vibration dampening seal disposed around the fuel injector and positioned in the head opening.

7. The invention as defined in claim 1 and comprising a bracket having a first end attached to the fuel rail and a dampener assembly which secures a second end of the bracket to the engine head, said dampener assembly including at least one elastomeric cushion disposed between said bracket and the engine head.

8. The invention as defined in claim 7 wherein said dampener assembly comprises a pair of elastomeric cushions, said cushions being disposed on opposite sides of said bracket, and a fastener extending through said cushions and said brackets which secures said bracket to the engine head.

9. The invention as defined in claim 8 and comprising a spacer disposed around said fastener which prevents over compression of said cushions.

10. The invention as defined in claim 9 and comprising a pair of washers disposed over said fastener so that said cushions and said bracket are sandwiched between said washers.

11. In a direct injection engine having a head with an opening to a combustion chamber, a direct injection fuel injector having a portion extending into said head opening and a fuel rail which supplies pressurized fuel through a fuel cup to the direct injection fuel injector, apparatus to reduce the transmission of vibration from the fuel rail to the engine head comprising:

a holder extending between the fuel cup and the engine head which extends around a fuel inlet end of the fuel injector so that the fuel injector is in alignment with the engine head opening, said holder being constructed of a vibration dampening material so that said holder dampens vibrations between the fuel cup and the engine head.

12. The invention as defined in claim 11 wherein said holder is constructed of an elastomeric material.

* * * * *